US008423372B2

(12) United States Patent
Ojanpera

(10) Patent No.: US 8,423,372 B2
(45) Date of Patent: Apr. 16, 2013

(54) PROCESSING OF ENCODED SIGNALS

(75) Inventor: Juha Petteri Ojanpera, Nokia (FI)

(73) Assignee: Sisvel International S.A., Luxembourg (LU)

( * ) Notice: Subject to any disclaimer, the term of this patent is extended or adjusted under 35 U.S.C. 154(b) by 2220 days.

(21) Appl. No.: 10/928,620

(22) Filed: Aug. 26, 2004

(65) Prior Publication Data

US 2006/0047523 A1 Mar. 2, 2006

(51) Int. Cl.
*G10L 21/04* (2006.01)

(52) U.S. Cl.
USPC ..... 704/503

(58) Field of Classification Search ..... 704/200.1, 704/500–504; 700/94
See application file for complete search history.

(56) References Cited

U.S. PATENT DOCUMENTS

| | | | | |
|---|---|---|---|---|
| 6,141,645 | A * | 10/2000 | Chi-Min et al. | 704/500 |
| 6,205,430 | B1 * | 3/2001 | Hui | 704/500 |
| 6,356,870 | B1 * | 3/2002 | Hui et al. | 704/500 |
| 6,718,309 | B1 | 4/2004 | Selly | |
| 6,801,898 | B1 * | 10/2004 | Koezuka | 704/500 |
| 2002/0111704 | A1 | 8/2002 | Suzuki | |
| 2004/0196989 | A1 * | 10/2004 | Friedman et al. | 381/119 |

FOREIGN PATENT DOCUMENTS

| | | |
|---|---|---|
| TW | 518557 | 1/2003 |
| WO | 02/09090 | 1/2002 |

OTHER PUBLICATIONS

"Subband based MPEG audio mixing for internet streaming application;" Patrick de Smet et al; 2001 IEEE International Conference on Acoustics, Speech and Signal Processing Proceedings; May 7-11, 2001, vol. 1 of 6; pp. 1393-1396.
"Direct manipulation of MPEG compressed digital audio;" M.A. Broadhead et al; ACM Multimedia 95, Nov. 5, 1995; retrieved from the Internet: URL:http://delivery.acm.org/10.1145/220000/215314/p499-broadhead.html.
"Information technology—Coding of audio-visual objects—Part 3: Audio;" International Organisation for Standardisation ISO/IEC; JTC 1/SC 29/WG 11 Coding of Moving Pictures and Audio; Jan. 31, 2000; pp. 146-148.
Online! XP002357740; Beatlock; User guide, version 3.0 build 49; retrieved from the Internet Dec. 6, 2005; paragraph 05.4; http://www.djmixpro.com/djmixpro/djmixprodoc.html.
Karlheinz Brandenburg and Gerhard Stoll; "*ISO-MPEG-1 Audio: A Generic Standard for Coding of High-Quality Digital Audio*"; presented at the 92nd Convention of the Audio Engineering Society, Vienna, Austria; Mar. 1992, revised Jul. 1994.
IEEE Transactions on Broadcasting; "*Guide to MPEG-1 Audio Standard*"; Seymour Shlien; vol. 40, No. 4; Dec. 1994.
ISO/IEC Technical Corrigendum; "*Information Technology—Coding of Moving Pictures and Associated Audio for Digital Storage Media at up to About 1,5 Mbit/s*", Apr. 1996.
IEEE; Davis Pan, Motorola; "*A Tutorial on MPEG/Audio Compression*"; 1995.

(Continued)

*Primary Examiner* — Angela A Armstrong

(57) ABSTRACT

The invention relates in general to a method for combining frequency domain encoded signals from at least two signal sources. To allow combining signals without decoding the signals entirely, the invention provides decoding the encoded signals obtaining quantized spectral components, inverse quantizing the quantized spectral component of the decoded signals obtaining window sequences, and combining the at least inverse quantized signals obtaining a combined signal.

25 Claims, 10 Drawing Sheets

OTHER PUBLICATIONS

ISO/IEC 13818-7; ISO/IEC JTC1/SC29/WG11; M. Bosi, K. Brandenburg, S. Quackenbush, M. Dietz, J. Johnston, J. Herre, H. Fuchs, Y. Oikawa, K. Akagiri, M. Coleman, M. Iwadare, C. Lueck, U. Gbur, B. Teichmann; "*IS 13818-7* (*MPEG-2 Advanced Audio Coding, AAC*"; Apr. 1997.

ISO/IEC 14496-3; "*ISO/IEC 14496-3* (*MPEG-4 Audio*)"; 2001.

ISO/IEC; Marina Bosi, Karlheinz Brandenburg, Schuyler Quackenbush, Louis Fielder, Kenzo Akagiri, Hendrik Fuchs, Martin Dietz, Juergen Herre, Grant Davidson, and Yoshiaki Oikawa; "*ISO-IEC/MPEG-2 Advanced Audio Coding*"; presented at the 101st Convention, Los Angeles, California, Nov. 1991.

Search Report, Republic of China Application 94128690 filed Aug. 23, 2005, dated Nov. 30, 2011, 1 page.

English Abstract, DEPATISnet, Publication TW-518557, published Jan. 21, 2003, 2 pages.

* cited by examiner

```
InitFading ( fadeVolume, frameCount, fadeMode )
{
   if ( fadeVolume > 100 ) fadeVolume -= 100 ;
   numFadeLevels = ⌊FADEZEROLEVEL - ( ( FADEZEROLEVEL* fadeVolume ) / 100)⌋;
   if ( numFadeLevels < 0 ) numFadeLevels = -numFadeLevels ;
   fadeGrid = ⌊frameCount / numFadeLevels⌋;

   if ( fadeMode == FADE_IN )
   {
    gainDec = numFadeLevels + 1;  incStep = -1;
   }
   else if ( fadeMode == FADE_OUT )
   {
    gainDec = -1;  incStep = 1;
   }
}
```

Fig.8

```
ModifyGlobalGains ( globalGains, audioFormat )
{
   /*
    * mp3 and AAC reserve 8 bits for the global gain,
    * that's why mask 255 is used.
    */
   if ( audioformat == MP3 )
   {
     for ( gr = 0 ;  gr < num_mp3_granules ;  gr++ )
       for ( ch = 0 ;  ch < num_mp3_channels ;  ch++ )
       {
          tmp = globalGains [gr] [ch] – gainDec ;
          if ( tmp < 0 ) tmp = 0 ;
          globalGains [gr] [ch] = tmp & 255 ;
       }
   }
   else if ( audioFormat == AAC )
   {
     for ( ch = 0 , ch < num_syntactic_aac_elements ;  ch++ ;
     {
       tmp = globalGains [ch] – gainDec ;
       if ( tmp < 0 ) tmp = 0 ;
       globalGains [ch] = tmp & 255 ;
      }
   }
}
```

Fig.9

```
• Initialize fading values ( pseudo-code 1 )
• for ( i = 0 ; i < frameCount ; i++ )
  {
     Extract global gain(s) from the mp3 or AAC bitstream
     If ( ( i % fadeGrid ) == 0 ) gainDec += incStep ;
     Modify global gain(s) ( pseudo-code 2 )
     Insert modified global gain(s) back to the bitstream
  }
```

PROCESSING OF ENCODED SIGNALS

FIELD OF THE INVENTION

The invention relates in general to a method for combining frequency domain encoded signals from at least two signal sources. This invention relates also in general to an audio content processing system and specifically to a compressed audio content processing system. The invention also relates to providing a volume fading for compressed audio signals.

BACKGROUND OF THE INVENTION

Compression methods for audio signals have been established in the art which adhere to the traditional paradigm of perceptual audio coding by coding a spectral representation of the input signal. This approach applies coding in the frequency domain rather than in the time domain of signal. However, even for other signals, such as video signals, spectral frequency domain coding is possible.

For example, coding according to the MPEG 1- or MPEG 2-layer 3 (mp3) audio format has been established as a defacto standard in the Internet at least as far as audio file distribution and archiving is concerned. Other frequency domain compression methods have, however, also been established as standards, such as the advanced audio coding (AAC) of MPEG-4, AC-3 of Dolby and other frequency domain encoding methods. The success of these compression methods has also created new markets for hand-held devices that are dedicated to the playback of such compressed audio files.

In depth explanations of the compression methods may be found in

K. Brandenburg, G. Stoll, "*ISO-MPEG-1 audio: a generic standard for coding of high-quality digital audio*", *J. Audio. Eng. Soc., Vol.* 42, No. 10, October 1994, pp. 780-792.

In mobile devices, such as mobile communication devices, or mobile consumer electronic devices, the compression standard mp3 is supported as one of the possible audio formats. One example for applying the audio formats may be ringing tones. Compressed audio files may, for instance, be used as ringing tones. Since ringing tones are typically short in duration, the user might want to create a personalized ringing tone as opposed to an audio clip extracted directly from a compressed audio file. Another example, for instance, may be an audio editor application for creating personalized user content from an existing audio content database.

Within a mobile device, a database may comprise a collection of compressed audio files. However, personalization may require audio content creation tools. These may, for example, be editing tools, allowing editing the audio content. However, editing compressed files, in particular files, which have been compressed according to a frequency domain compressing method, may not be possible. Editing in the compressed domain with standard tools is not supported due to the nature of the frequency domain compressed signals. As in the compressed domain the bit stream is not a representation of the perceptual audio file in the time domain, mixing different signals is not possible without decoding.

In addition, fade-in and fade-out mechanisms are easy to implement for time domain signals. However, the computational complexity of decoding compressed audio signals is a constraint to apply fading. Both decoding and encoding would have to be implemented in case time domain fading methods were to be used. The drawback is that compressed audio bit streams, such as MPEG Audio formats, typically require a lot of computational complexity. For instance, in mobile devices, the decoding consumes much of the processing abilities, in particular as computational resources are typically limited.

Handling compressed bit streams, in particular in the frequency domain, might however be desirable. The drawback of current systems is the lack of editing possibilities in the frequency domain. The need for complete decoding the compressed data stream prior to editing increases computation time and implementation costs. There is a need for editing compressed files without the need of decompressing. For instance, mixing different signals into one single file may be desirable.

In addition, providing fading effects, such a fade-in and fade-out, might be desired even with compressed data. For instance, in mobile equipment, these editing tools for compressed audio signals are desirable.

SUMMARY OF THE INVENTION

To overcome these drawbacks, embodiments provide a method for combining frequency domain encoded signals from at least two signal sources, with decoding the encoded signals obtaining quantized spectral components, inverse quantizing the quantized spectral component of the decoded signals obtaining window sequences, and combining the at least inverse quantized signals obtaining a combined signal.

The simplest case to implement a combination of at least two signals would be to manipulate the raw bit streams directly. However, this does not work in practice, since each data frame has been optimized for the particular signal. Making changes to the spectral samples is difficult due to coding. In addition, bit stream formatting would be a very challenging task, since the syntax has been defined by the compression standard, which sets limitations to the raw bit stream manipulation.

Hence, some decoding of the bit streams is needed. Nevertheless, the computational complexity should be kept within reasonable limits as will be possible according to the invention.

The inventive method allows mixing at least two compressed bit streams into one compressed bit stream, without the need to decompress the bit streams entirely. Only partial decompression is necessary.

To reduce redundancy, an entropy coding is applied to the compressed signal. This, for instance, may be done by applying a Huffman coding. Thereby, the quantized spectrum may be divided into three different regions and separate Huffman tables may be assigned to the respective regions. To create a quantized spectrum of the signals to be processed, the encoded bit stream needs to be decoded first. Decoding may, for instance, be done by applying an inverse Huffman decoding. The resulting bit stream may represent the quantized spectral components of the signals.

The first possible point for mixing would be after decoding. However, the disadvantages of this approach are that the amplitude scaling of the signals is not known. In addition, the signal sources might be in different domains. For instance, in AAC coded signals, a temporal noise shaping (TNS) might not be enabled in both of the signal sources. Therefore, the quality of the signals is unpredictable. Another disadvantage may result from the fact that the signal sources to be mixed might use different frequency resolutions. This may lead to very severe quality problems.

The second possible point for mixing is after inverse quantization. The only limitation here is the frequency resolution. One cannot assume that the frequency resolution is the same all the time. In frequency domain compressed signals, a block length of data blocks may define the frequency resolution. For different block lengths, different window sequences are applied. These window sequences may be long, short, long-to-short, and short-to-long.

During compression, a filterbank processing is applied to the signals. A dynamic window switching is applied, for instance using a modified discrete cosine transform (MDCT). The result is a sequence of windows. These windows allow achieving spectral decomposition and redundancy reduction. Short windows are used to handle transient signals, whose characteristics change rapidly in time.

Since most of the time the frequency resolution is the same for most of the signals, the window sequences of the different signal may be mixed. No complete decompression is necessary for mixing the signals.

The inventive method allows omitting filterbank computation. The synthesis polyphase filterbank is computationally the most expensive. It has been reported that over half of the total decoding time is spent on the synthesis filterbank block. Therefore, omitting this step when combining two signals, may reduce computation complexity by more than half.

Embodiments provide inverse transforming at least one of the window sequences obtaining a sub-band signal, and re-transforming the sub-band signal into a modified window sequence with a frequency resolution matching a frequency resolution of a window sequence from at least a second signal, which has not been inverse transformed.

Both mp3 and AAC audio formats, as well as other frequency domain compression methods, apply shorter transform length to signal segments that are transient in nature. This leads to different frequency resolutions. Signals, which have different frequency resolution, however, should not be mixed with one another, as the quality of the resulting signal is not be predictable. Usually, long window sequences are used. Short window sequences are used for transient signals. These sequences, however, usually occur seldomly. After decoding the first bit stream, it will most likely have the same window sequence as the second bit stream. In such a case, there is no need for re-computing the window sequence of the first signal to match with the window sequence of the second signal.

Only in case the window sequences of the two signals differ, matching may need to be computed. The conversion of window sequences is only done for those frames, which do not have the same window sequence, and so the computation amount is reduced. However, it may be necessary to store temporally neighboring windows, as the conversion may require information about neighboring windows. In order to make the conversion work, coding frames from a previous, a current, and a following frame may need to be stored. The reason for this may be that transformation uses a lapping method. This may result in a 50% overlapping of temporally neighboring windows. For instance, MDCT provides overlapping between blocks and the MDCT coded frames are reconstructed such that the first half of a current frame, after applying IMDCT, is added to the latter half of previous frame. The current frame may be restored for forward MDCT by adding the latter half of previous frame to the first half of current frame, and adding the latter half of current frame to the first half of following frame. After this, forward MDCT using the window sequence of the second mp3 bit stream may be applied to obtain the proper signal for combining.

These embodiments provide decoding at least one of the signals into a sub-band signal. That may be a signal, which is obtained during encoding after the filterbank, prior to applying the MDCT. The window length of the other signal, which is to be combined with the sub-band signal is obtained. With the knowledge about this window length, re-transforming the sub-band signal may be applied. The re-transformation allows for adjusting the frequency resolution to watch the frequency resolution of the other signal. In such a case, the window sequences have equal length. Combining these two signals may then be possible without constraints due to different frequency resolutions.

Further embodiments provide inverse transforming at least two of the window sequences and combining the transformed windows sequences within the same transformation domain. These embodiments provide mixing signals with inverse transforming at least two of the window sequences into a sub-band signal, respectively, and combining at least two of the sub-band signals into a combined sub-band signal. In this case, the signals to be combined need to be decompressed until sub-band signals are available. This may be the case after inverse modified cosine transformation (IMDT).

The amplitude levels of the signals to be combined may be adjusted according to embodiments. This may allow defining the signal strength of each of the combined signals. For instance, one of the signals may be mixed to the background of the other signal.

Embodiments provide band-limiting at least one of the signals prior to combining the signals. Band-limiting at least one of the signals may scale down the whole decoding complexity. Only the part of the spectrum which is actually needed at the mixer stage is decoded and processed. For example, if only half of the spectrum is added to the first signal, the IMDCT+MDCT+alias reduction processing needs to be applied only to the first 16 sub-bands of the second signal. In case of a stereo signal, it may also be possible to mix the second signal as mono signal to save further processing time.

Encoding the spectral components of the combined signal into a frequency domain encoded output signal is also provided according to embodiments. The combined signal may be compressed with less computation complexity than wholly compressing a time domain signal.

For encoding of the mixed signal, it is advantageous to utilize the coding information that is already available in the input frames. This saves computational complexity. If the mixing in the MDCT domain is applied, for instance, only quantization, Huffman coding, and bit-stream formatting may be necessary.

The quantization steps may be simplified if existing scaling values from the input frames are at least partly used. The mp3 frame is divided into three sections: which may be header, side info, and payload part. The header is mainly used for frame synchronization and for determining the channel and coding configuration of the payload section of the frame. The payload part contains the scaling values for the spectra and the Huffman coded spectral samples. Some side information needs to be associated with the payload part. The side information describes, for example, the Huffman table numbers that are used for the spectral samples, the length of the payload part, the block type, etc.

Encoding the signals, which are mixed in sub-band domain, may require additional MDCT processing. Nevertheless, the encoding process remains the same. Significant complexity reductions can be achieved since the polyphase filterbank stage during compression is not needed. It has been estimated that 60% of the total encoding time is spend on psychoacoustics and polyphase filterbank analysis. Omitting this step reduces computation time significantly.

Another aspect of the invention is a system arranged for combining frequency domain encoded signals from at least two signal sources, comprising a decoder arranged to decode the encoded signals obtaining quantized spectral components, an inverse quantizer arranged for inverse quantizing the quantized spectral component of the decoded signals obtaining window sequences, and a combiner arranged for combining the at least inverse quantized signals obtaining a combined signal.

A further aspect of the invention is a module comprising such a system and the use of such a system in consumer electronic devices or mobile communication devices.

Yet, a further aspect of the invention is a computer program product comprising a computer program stored thereon for combining frequency domain encoded signals from at least two signal sources, the program comprising instruction operable to cause a processor to decode the encoded signals obtaining quantized spectral components, inverse quantize the quantized spectral component of the decoded signals obtaining window sequences, and combine the at least inverse quantized signals obtaining a combined signal.

According to another aspect, a method for providing fading within a frequency domain encoded audio signal, with obtaining from the bit stream of the frequency domain encoded audio signal the bit stream element representing the global amplitude level value, and changing the bit stream element representing the global amplitude level value for frames and channels of the encoded audio signal with an alternation value, wherein the alternation value is changed every n-th frame, where n is determined from a number of fade levels and a length of the fading is provided.

This method may provide fading effects to encoded audio signals without the need to decompress the compressed signal. For instance, MP3 audio files or AAC audio files may be edited without processing constraints. These embodiments remove the need for decompressing and re-compressing the audio files when fading effects are required.

The bit stream element representing the global amplitude level value may, for instance, be a global_gain parameter, provided within the bit streams of MP3 and AAC audio streams. This global_gain parameter is used separate from scalefactors in MP3 files and as a starting value for the scalefactors in AAC files. By only modifying this bit stream element accordingly, fade-in and fade-out effects may be obtained.

Embodiments provide determining the value n from the quotient of the number of fade levels and the length of the fading. For example, the number of fade levels may be determined from the fade volume, e.g. the relative change in the volume level. In addition, the length for instance in terms of a number of frames, of the fading may, for example, be determined from $$frameCount = \left\lfloor \frac{\text{width of fading region in milliseconds}}{\text{length of one audio frame in milliseconds}} \right\rfloor.$$

Insofar, the value n determining after which number of frames the alternation value may be changed, may be determined from the frame count and the fade level. For instance, the value n may also be chosen in a logarithmic order, or any other curve order. However, the alternation value may be constant. The change in the volume may be determined from accumulated alternation values, which accumulation is done every n frames. For example, for the first ten frames the cumulated alternation value is 2, for the next ten frames 4, and for the next ten frames 6, and so on.

Embodiments provide changing the bit stream element representing the global amplitude level value for each frame and each channel within a fading period of the encoded audio signal. The alternative value may, however, be constant over all frames within the period of n frames. The number of channels may be determined from the bit stream. Additionally, the volume level may be altered for every granule within an MP3 file. The number of granules may be determined as well from the bit stream. For AAC encoded files, the volume level may be changed for every syntactic AAC element, which may be determined from the bit stream on a frame-by-frame basis.

To allow correct fading with the desired fading volumes, embodiments provide determining a fade volume from an initial amplitude level or an ending amplitude level relative to the original amplitude level.

To enable fading effects without decoding, embodiments provide extracting the bit stream element representing the global amplitude level from the bit stream, changing the bit stream element representing the global amplitude level, and inserting the changed bit stream element representing the global amplitude level into the bit stream.

Another aspect of the invention is a device arranged for providing fading within a frequency domain encoded audio signal, comprising a parser arranged to obtain from the bit stream of the frequency domain encoded audio signal the bit stream element representing the global amplitude level value, a processing unit arranged to change the bit stream element representing the global amplitude level value for frames and channels of the encoded audio signal with an alternation value, wherein the processing unit is arranged to change the alternation value every n-th frame, where n is determined from a number of fade levels and a length of the fading.

A further aspect of the invention is a computer program product for providing fading within a frequency domain encoded audio signal, comprising a computer program, the program comprising instructions operable to cause a processor to obtain from the bit stream of the frequency domain encoded audio signal the bit stream element representing the global amplitude level value, and change the bit stream element representing the global amplitude level value for frames and channels of the encoded audio signal with an alternation value, with changing the alternation value every n-th frame, where n is determined from a number of fade levels and a length of the fading.

Yet, a further aspect of the invention is the use of such a method within an electronic device or a mobile communication device.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

BRIEF DESCRIPTION OF THE DRAWINGS

In the Figures show:

FIG. 9 a second pseudo code for implementing a fading effect;

DETAILED DESCRIPTION

Throughout the following figures, same reference numbers refer to similar elements with similar functionality.

Audio compression is a form of data compression designed to reduce the size of audio data files. Audio compression algorithms are typically referred to as audio codecs. As with other specific forms of data compression, there exist many lossless algorithms. In addition, algorithms, which introduce loss to the signal to achieve the compression effect are also known in the art. Some examples of lossy codecs are Layer 2 audio codec for MPEG-1 and MPEG-2 (MP2), Layer 3 audio codec for MPEG-1, MPEG-2 and non-ISO MPEG-2.5 (MP3), Musepack (MPC), Ogg Vorbis, Advanced Audio Coding for MPEG-2 and MPEG-4 (AAC), AC-3 for Dolby, or Windows Media Audio (WMA).

Due to the nature of lossy algorithms, audio quality suffers when a file is decompressed, and thereafter recompressed (generation losses). Therefore, editing signals, which have been compressed with a lossy algorithm should prevent decompressing the signals entirely. Decompressing, editing, and thereafter compressing audio files for editing purposes should be prevented.

Figure 1:
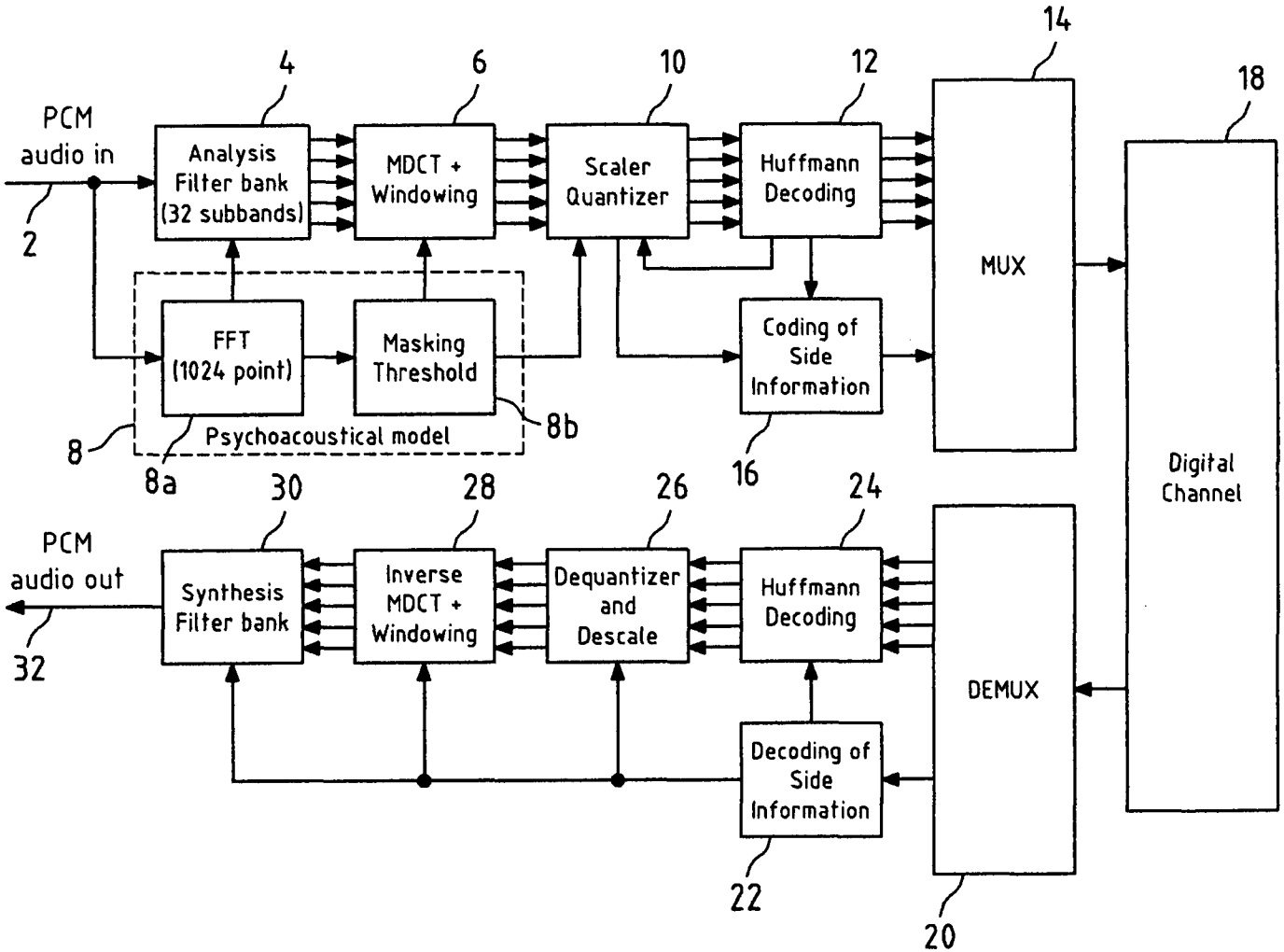
FIG. 1 schematically a block diagram of an MP3 encoding, decoding system.

FIG. 1 illustrates a coding, decoding system for compressing audio files in an MP3 format. A detailed description may be found in

*ISO/IEC JTC1/SC29/WG11 (MPEG-1), Coding of Moving Pictures and Associated Audio for Digital Storage Media at up to about* 1.5 *Mbit/s, Part* 3: *Audio, International Standard* 11172-3, *ISO/IEC,* 1993, D. Pan, "*A tutorial on MPEG/Audio compression", IEEE Multimedia,* Vol. 2, 1995, pp. 60-74, and S. Shlien, "*Guide to MPEG-1 Audio standard", IEEE Trans. on Broadcasting,* Vol. 40, No. 4, December 1996, pp. 206-218.

The system for encoding a pulse code modulated (PCM) input signal 2 comprises an analysis filter bank block 4. The analysis filter bank block 4 may decompose the input signal into 32 sub-bands of equal bandwidth using polyphase interpolation. For coding, the sub-band samples may be grouped into 18×32 samples.

A polyphase quadrature filter (PQF), may represent a filter bank, which splits an input signal into a given number N of equidistant sub-bands. These sub-bands may be sub-sampled by a factor of N.

This sampling may introduce aliasing. Similar to the MDCT time domain alias cancellation, the aliasing of the PQFs is canceled by neighboring sub-bands, i.e. the signals are typically stored in two sub-bands.

PQF filters are used in MPEG Layer I and II, in MPEG Layer III with an additional MDCT, in MPEG-4 AAC-SSR for the four band PQF bank and in MPEG-4 High Efficient AAC (HE AAC) for the analysis of the upper spectral replicated band.

A PQF filter bank is constructed using a base filter, which is a low-pass. This low-pass is modulated by N cosine functions and converted to N band-passes.

The sub-band signal may then be processed by a MDCT and Windowing block 6. This MDCT and Windowing block 6 may increase the coding efficiency and spectral resolution by applying either 18- or 36-point MDCT to each of the 32 sub-bands.

The modified discrete cosine transform (MDCT) is a frequency transform based on the type-IV discrete cosine transform (DCT-IV), with the additional property of being lapped. It is designed to be performed on consecutive blocks of a larger dataset, where subsequent blocks are 50% overlapped. There also exists an analogous transform, the modified discrete sine transform MDST, based on the discrete sine transform, as well as other forms of the MDCT based on different types of DCT.

Figure 3:
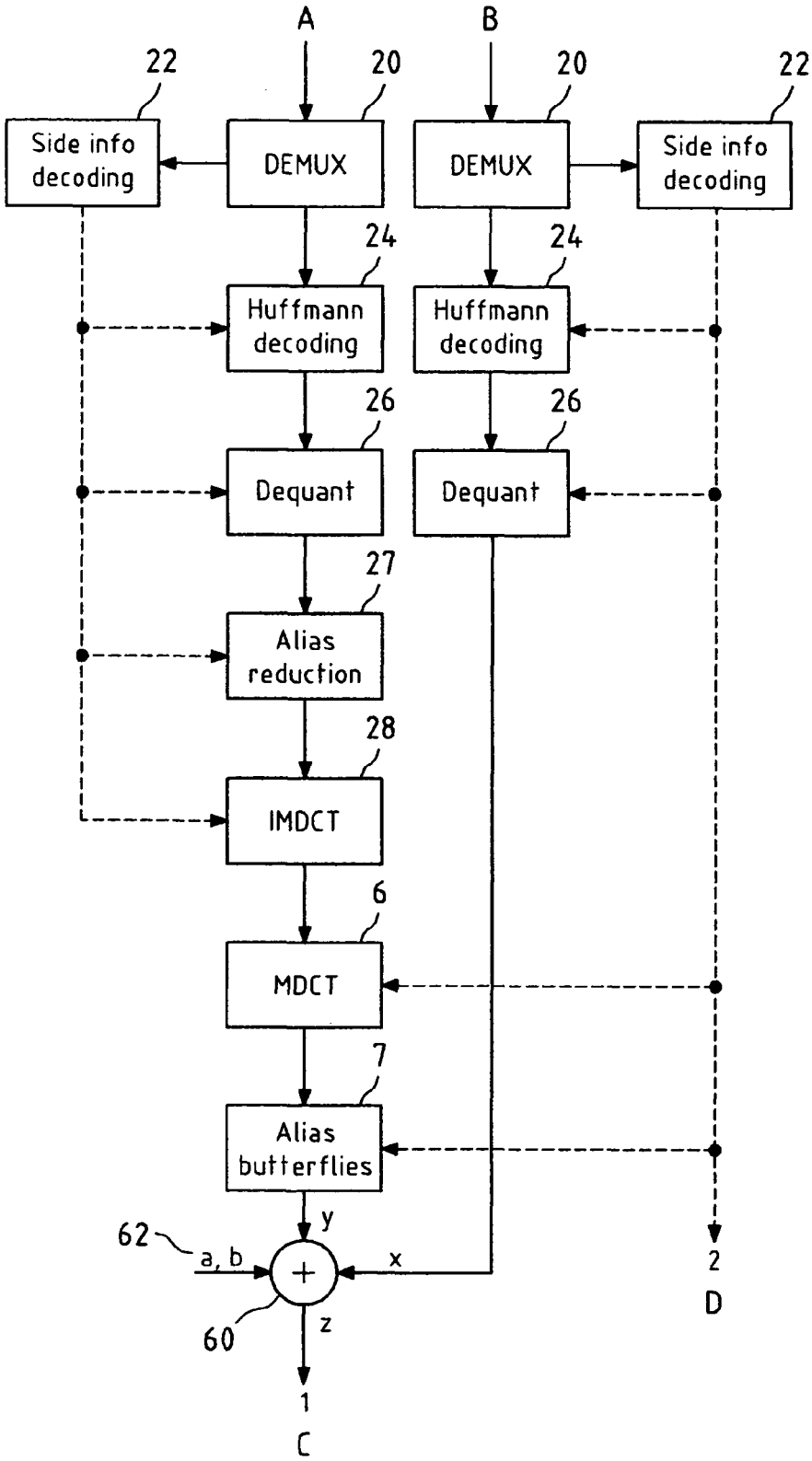
FIG. 3 schematically a block diagram of a first inventive mixing system for mixing mp3 compressed signals.
Figure 4:
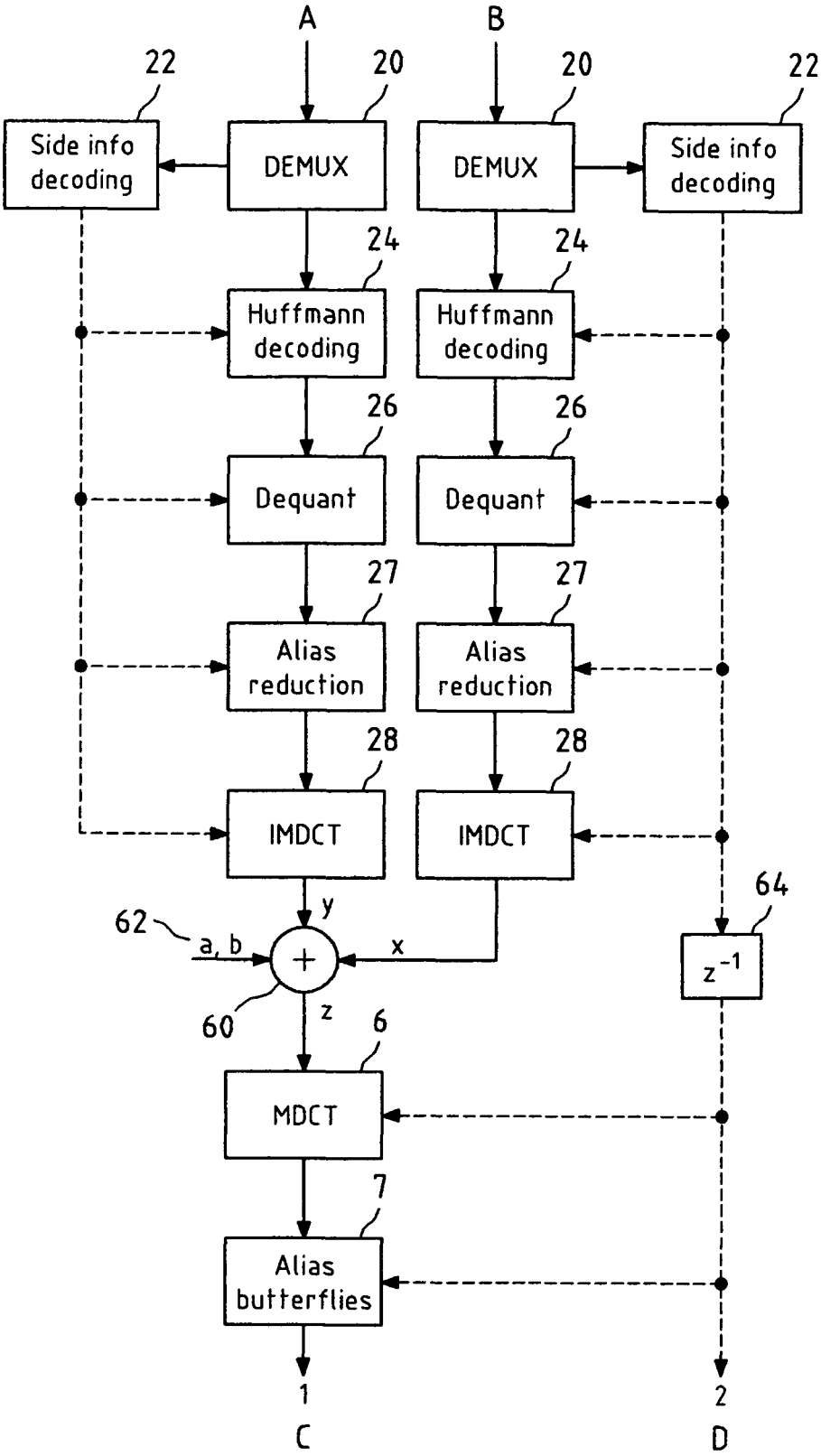
FIG. 4 schematically a block diagram of a second inventive mixing system for mixing mp3 compressed signals FIG. 5 schematically a block diagram of an inventive encoding system for encoding mixed mp3 compressed signals FIG. 6 schematically a block diagram of a third inventive mixing system for mixing AAC compressed signals FIG. 7 schematically a block diagram of an inventive encoding system for encoding mixed AAC compressed signals FIG. 8 a first pseudo-code for implementing a fading effect.

In MP3, the MDCT is applied to the output of a 32-band polyphase quadrature filter (PQF) bank of block 4. The output of this MDCT and Windowing block 6 may be post-processed by an alias reduction block as shown in FIGS. 3 and 4 within alias butterflies block 7, to reduce the typical aliasing of the PQF filter bank.

To allow compression, a psychoacoustical model 8 is provided. This block converts the input signal 2 into its spectral components by Fast Fourier Transform (FFT) block 8*a*. A signal analysis can be applied to the spectral samples to decide the best performing transform length for the MDCT and windowing block 6. Also a masking threshold 8*b* can be determined for the spectral samples on a frequency band basis to define the amount of noise that can be introduced into each frequency band by the quantizer block 10 without introducing any audible artifacts into the signal.

The window sequence put out by MDCT and windowing block 6 is fed to a scalar quantizer block 10. The signal-to-noise ratio (SNR) is kept constant over the windows by raising the input samples to ¾ power before the actual quantization process takes place. The quantizer block 10 may operate over 22 frequency bands that approximate critical bands. A scalefactor may be assigned to each band that is further adjusted to meet the given bitrate.

The output of the scalar quantizer block 10 is fed to Huffman coder block 12. Within Huffman coder block 12, the quantized spectrum is divided into three distinct regions and a separate Huffman table (Huffman codebook) is assigned to each region. The maximum value that each codebook can represent may be limited to 15.

The output signal of Huffman coder block 12 is fed to multiplexer 14. In addition, side information, e.g. scaling values of the scalar quantizer block 10, may be coded in coding block 16 and fed to multiplexer 14. Multiplexer 14 computes a signal to be transmitted via a digital channel 18 to a receiving demultiplexer 20.

At the decoder side, the operations are done in reverse order. The samples are passed through all the blocks 22-30 and each block will perform the reverse operation to the signal.

The first block is Huffman decoding block 24. The output of Huffman decoding block 24 is a quantized spectral signal. To allow decoding, dequantizing, inverse MDCT and inverse windowing, side information decoding block 22 is provided, decoding the encoded side information.

The output of Huffman decoder block 24 is fed to dequantizer block 26. Within the dequantizer block 26, the quantized spectrum signal may be converted into a window sequence.

The window sequence is fed to inverse MDCT and windowing block 28. The inverse MDCT is known as the IMDCT. There are different numbers of inputs and outputs. However, perfect invertibility is achieved by adding the overlapped IMDCTs of subsequent overlapping blocks, causing the errors to be reduced and the original data to be retrieved.

The output of inverse MDCT and windowing block 28 is a sub-band signal. This sub-band signal is fed to synthesis filter bank block 30, which computes the output PCM signal 32, which may be a representation of the input PCM signal 2 with some loss. The loss may be introduced to the input signal 2 by the masking threshold block 8*b* and MDCT and windowing block 6.

Figure 2:
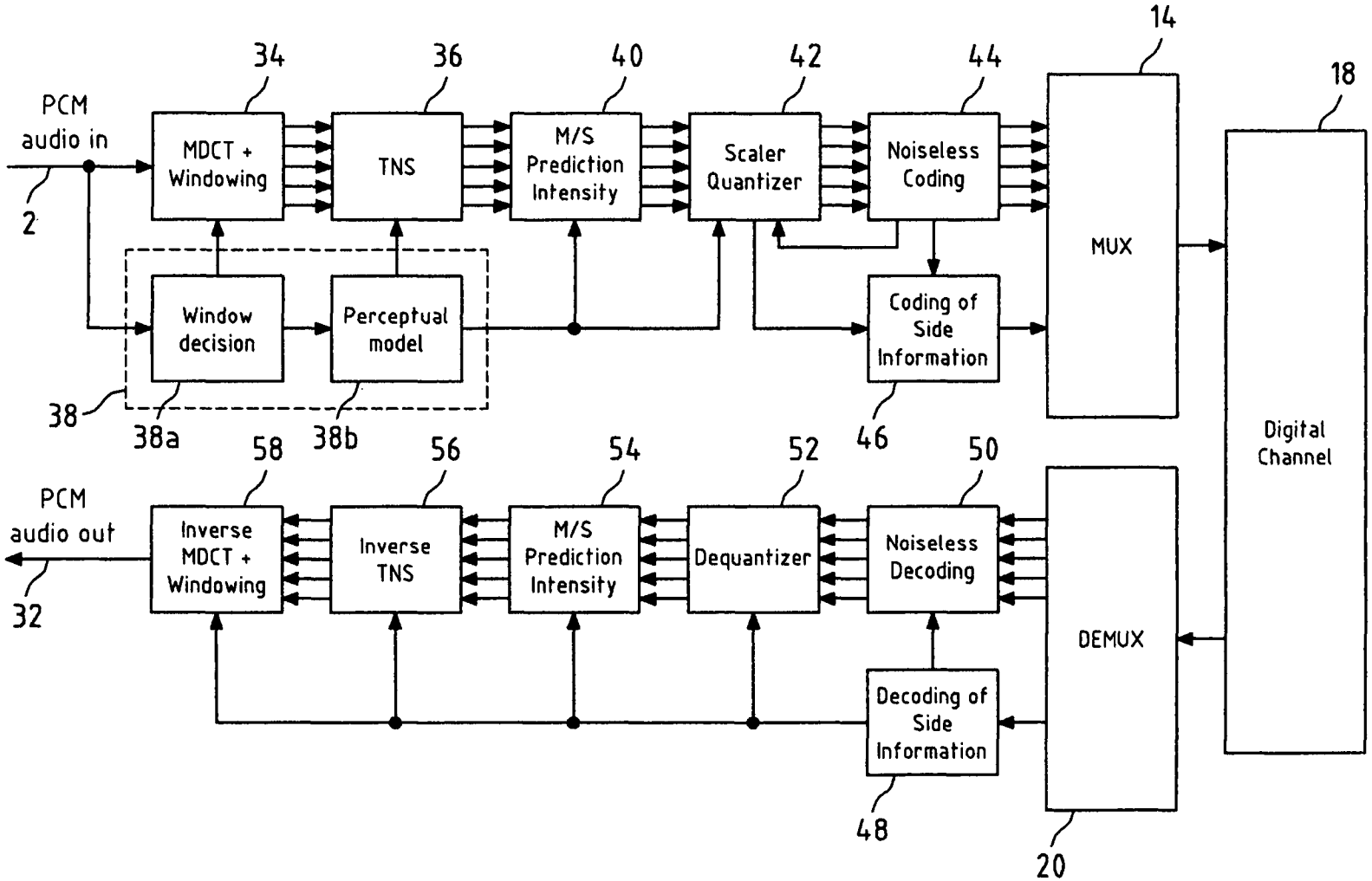
FIG. 2 schematically a block diagram of an AAC encoding, decoding system.

FIG. 2 illustrates an AAC encoder and decoder. A detailed description may be found in

*ISO/IEC JTC1/SC29/WG11* (*MPEG-2 AAC*), *Generic Coding of Moving Pictures and Associated Audio, Advanced Audio Coding, International Standard* 13818-7, *ISO/IEC,* 1997,

*ISO/IEC JTC1/SC29/WG11* (*MPEG-4*), *Coding of Audio-Visual Objects: Audio, International Standard* 14496-3, *ISO/IEC,* 1999, and M. Bosi, K. Brandenburg, S. Quackenbush, L. Fielder, K. Akagiri, H. Fuchs, M. Dietz, J. Herre, G. Davidson, Y. Oikawa, "*ISO/IEC MPEG-2 advanced audio coding*", 101st AES Convention, Los Angeles 1996

The technology used in MPEG AAC is very close to that of MPEG layer-3. The coding kernel of MPEG AAC is almost exactly the same what is used also in layer-3, only some of the parameter ranges are different.

However, MPEG AAC is not backward compatible with layer-3 and the coding efficiency is boosted with AAC specific coding blocks. The encoder comprises the following coding block, some of which are optional, that is, a decision whether to use that block may be made for each frame separately.

The input signal 2 is fed to MDCT filter bank block 34. This MDCT filter bank block 34 computes MDCT with dynamic window switching between window lengths 2048 to 256 bits. This allows achieving the spectral decomposition and redundancy reduction. Short windows may be used to handle transient signals. The output of the MDCT filter bank block 34 is a window sequence.

The window sequence may then be fed to a temporal noise shaping (TNS) block 36, which is an optional block. This TNS block 36 applies well-known linear prediction techniques in frequency domain to shape the quantization noise in time domain. This will result in a non-uniform distribution of quantization noise in time domain, which is especially useful feature for speech signals.

The MDCT filter bank block 34 and the temporal noise shaping block 36 are fed by outputs of a psychoacoustical model 38, which analyzes the input signal 2 within a window decision block 38*a* and a perceptual model block 38*b*.

The output of TNS block 36, which still may be a window sequence, may be fed to the optional MS-stereo and/or intensity stereo (IS) prediction block 40. For channel pairs, either MS, IS, or both may be used. MS-stereo transmits the sum and the difference of the left and right channel, whereas for intensity stereo, only one channel is transmitted. In intensity stereo, the two-channel representation is obtained by scaling the transmitted channel according to the information sent by the encoder (left and right channel have different scaling factors).

The output of MS-stereo and/or Intensity stereo (IS) prediction block 40 is fed to scalar quantizer block 42, which operates similarly to scalar quantizer block 10. Scalar quantizer block 40 provides non-uniform quantization. Also provided is noise shaping via scalefactors, which may be part of noiseless coding block 44 and/or scalar quantizer block 42. A scalefactor may be assigned to each frequency band. The scalefactor value is either increased or decreased to modify the signal-to-noise ratio and the bit-allocation of the band.

The scalar spectral components are fed to a Huffman coding, which may be part of a noiseless coding block 44. Coding gain may be achieved by differentially Huffman coding the scalefactors. Multiple codebooks may be combined with dynamic codebook allocation. A codebook may be assigned to be used in a particular frequency band only, or shared among neighboring bands.

The coded signal, together with side information, coded within side information coding block 16, is fed to multiplexer 14.

The output of demultiplexer 20 is fed to noiseless decoding block 50 and side information decoding block 48. The decoded signal is then fed to dequantizer block 52, which output is a window sequence. The signal is optionally fed to inverse MS-stereo and/or Intensity stereo (IS) prediction block 54, inverse TNS filter block 56 and inverse MDCT and Windowing block 58, which output is a PCM audio signal 32.

FIG. 3 illustrates a first method for combining signals. Two audio signals A, B are fed separately to demultiplexer blocks 20 and side information decoding blocks 22. The signals are process independently by Huffman decoder blocks 24, and dequantizer blocks 26. The resulting signals are window sequences.

The window sequence of signal A is fed to alias reduction block 27 and inverse MDCT block 28. The resulting signal is a sub-band signal.

The sub-band signal of signal A is fed to MDCT block 6, where a window sequence is generated. The MDCT block 6 receives in addition side information about signal B. This side information allows determining the window size of temporally corresponding frames of signal B. Using this information, the MDCT block 6 may compute a window sequence of signal A with equal window sizes as window sequence of signal B. The resulting window sequence is fed to alias butterflies block 7. At its output the window sequence is fed to mixer 60.

Within mixer 60, the window sequences of signal A and signal B are combined. As the window sequences match in size, combining is possible without constraints. If x represents the inverse quantized spectrum of the signal B and y the output of MDCT of signal A, the mixed signal z may be expressed as:

$$z(i)=(x(i)+a\cdot y(i))\cdot b,\ i=0,\ldots,N-1$$

where N is the number of spectral samples to be mixed, and a and b are constants describing the amplitude level adjustment for the mixed signal. These amplitude level adjustment signals a, b may be fed by signal 62 to mixer 60. By adjusting the amplitude levels, the signal A, B may be leveled in terms of volume.

Figure 5:
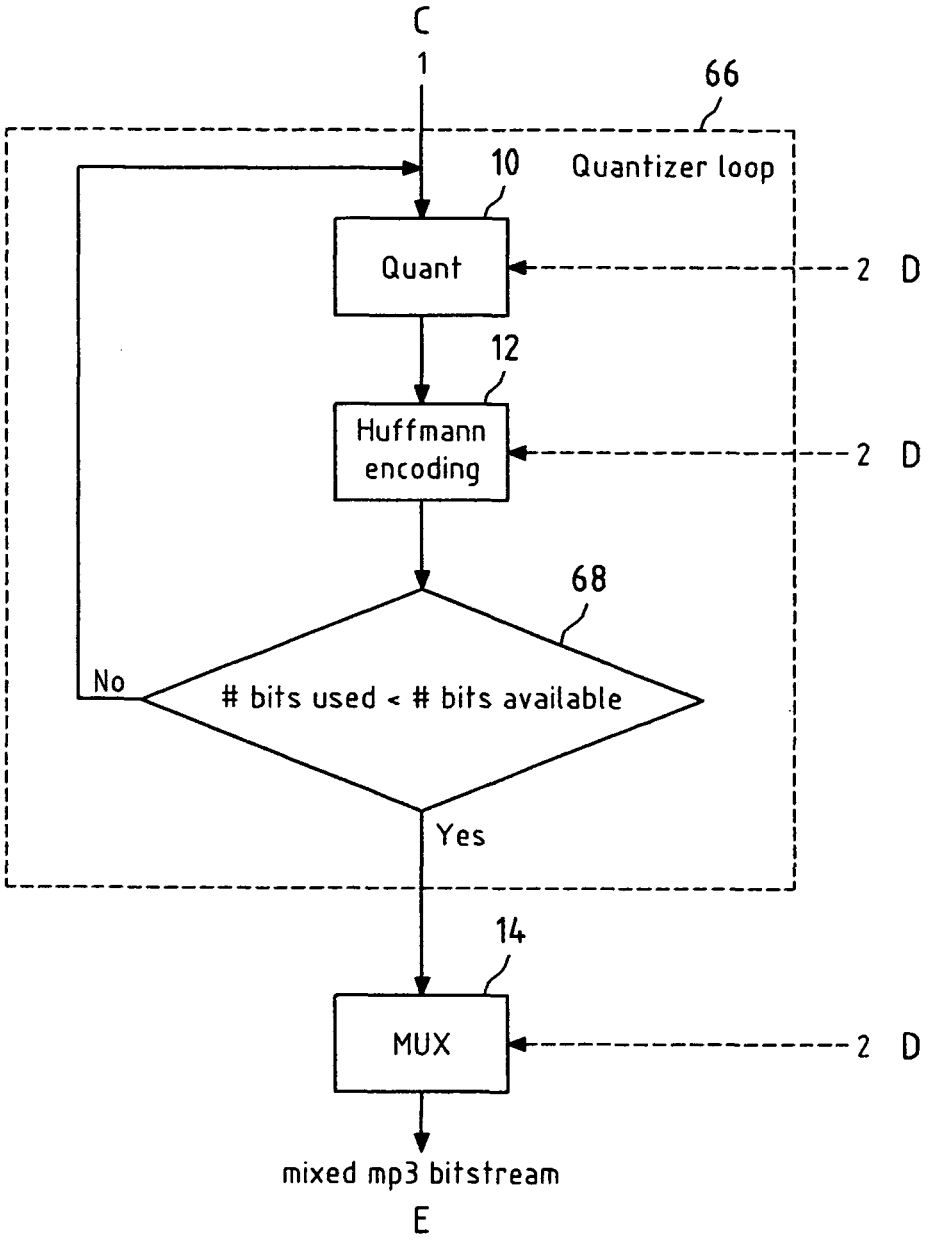

The combined signal may be encoded, as will be illustrated in FIG. 5.

FIG. 4 illustrates a second possible method for combining compressed audio signals, in particular mp3-compressed signals. The input signals A, B are independently processed by blocks 20, 22, 24, 26, 27, 28, which are similar to the blocks 20, 22, 24, 26, 27, 28 described in FIG. 1. The difference to the method according to FIG. 3 lies in the dequantization in block 26, alias reduction in block 27 and inverse MDC in block 28 of signal B. As a result, both signals A, B are connected into sub-band signals.

The output of IMDCT blocks 28 are sub-band signals. The sub-band signals of signals A, B are fed to mixer 60, where the signals are combined. Amplitude level adjustment may as well be possible by signal 62.

The output of mixer is fed to MDCT block 6 and alias butterflies block 7. To use already known side information concerning windowing, the side information from signal B may be fed to MDCT block 6. However, there needs to be a time shift for the side information of one frame, implemented by latency block 64, as the mixer 60 also introduces a time shift of one frame.

The resulting signal C is a window sequence of the combined signal, which may as well be encoded, as shown in FIG. 5.

FIG. 5 illustrates an encoder 66. The encoder 66 may be a quantizer loop. The input signal C is quantized in quantizer block 10, and Huffman coded in Huffman coder block 12. A formatting block 68 provides formatting a bit stream. The output signals are computed by multiplexer 14 and a mixed mp3 bit stream is put out as signal E.

Figure 6:
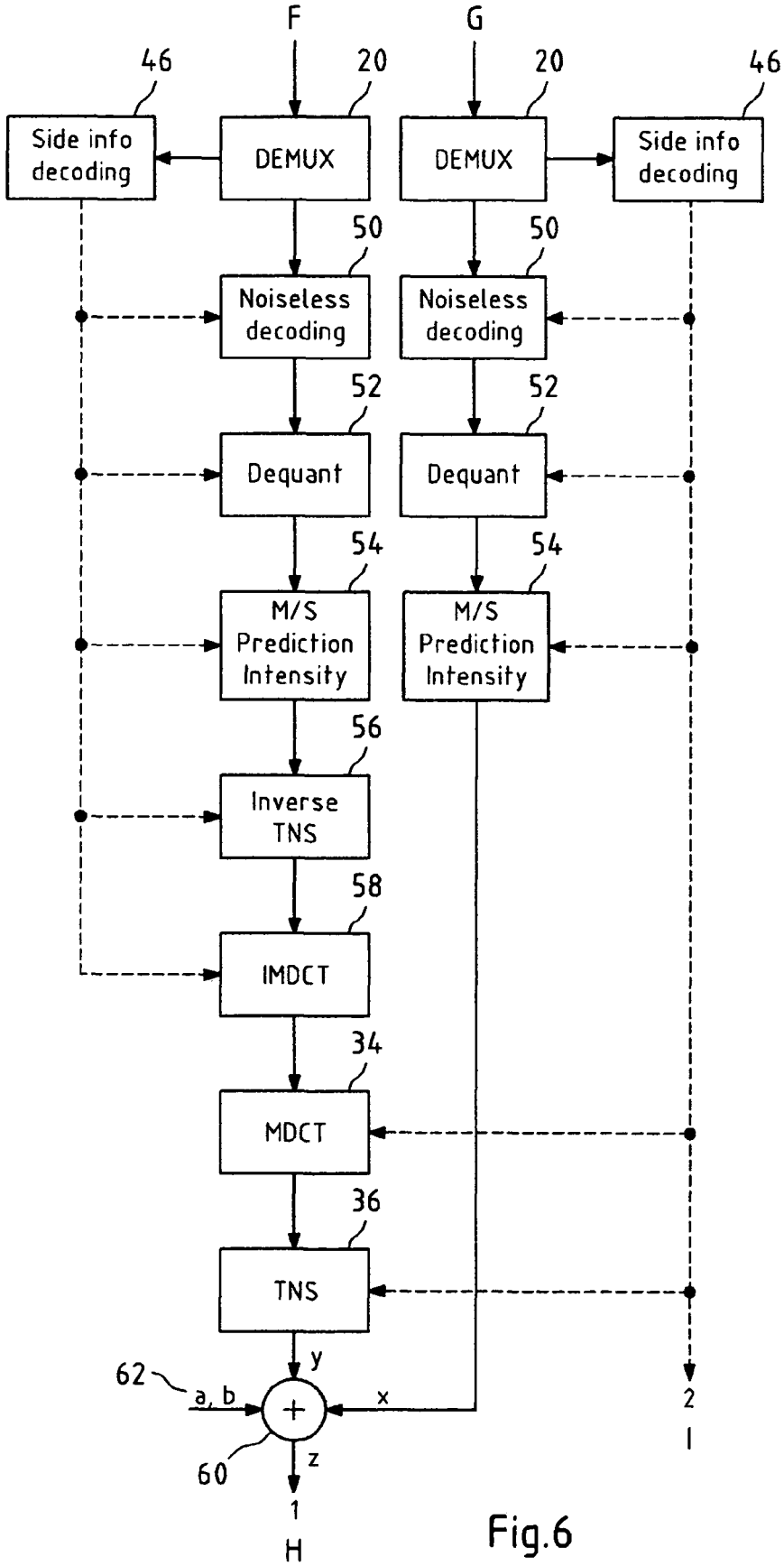

FIG. 6 illustrates mixing of AAC compressed signals F, G. The signals are computed independently by blocks 20, 46, 50, 52, 54, which are similar to those described in combination with FIGS. 2, 3.

The resulting signals are window sequences of each signal F, G. Signal F is further processed by blocks 56, and 58. The resulting signal is processed in block 34. During processing in block 34, side information concerning window sizes of temporally parallel windows of signal G are used from side information decoder 46. Using this information allows equaling the window sizes of the window sequences of signals F and G. The resulting signal is fed to block 36, where after it is combined with the window sequence of signal G in mixer 60 into a combined signal H.

Figure 7:
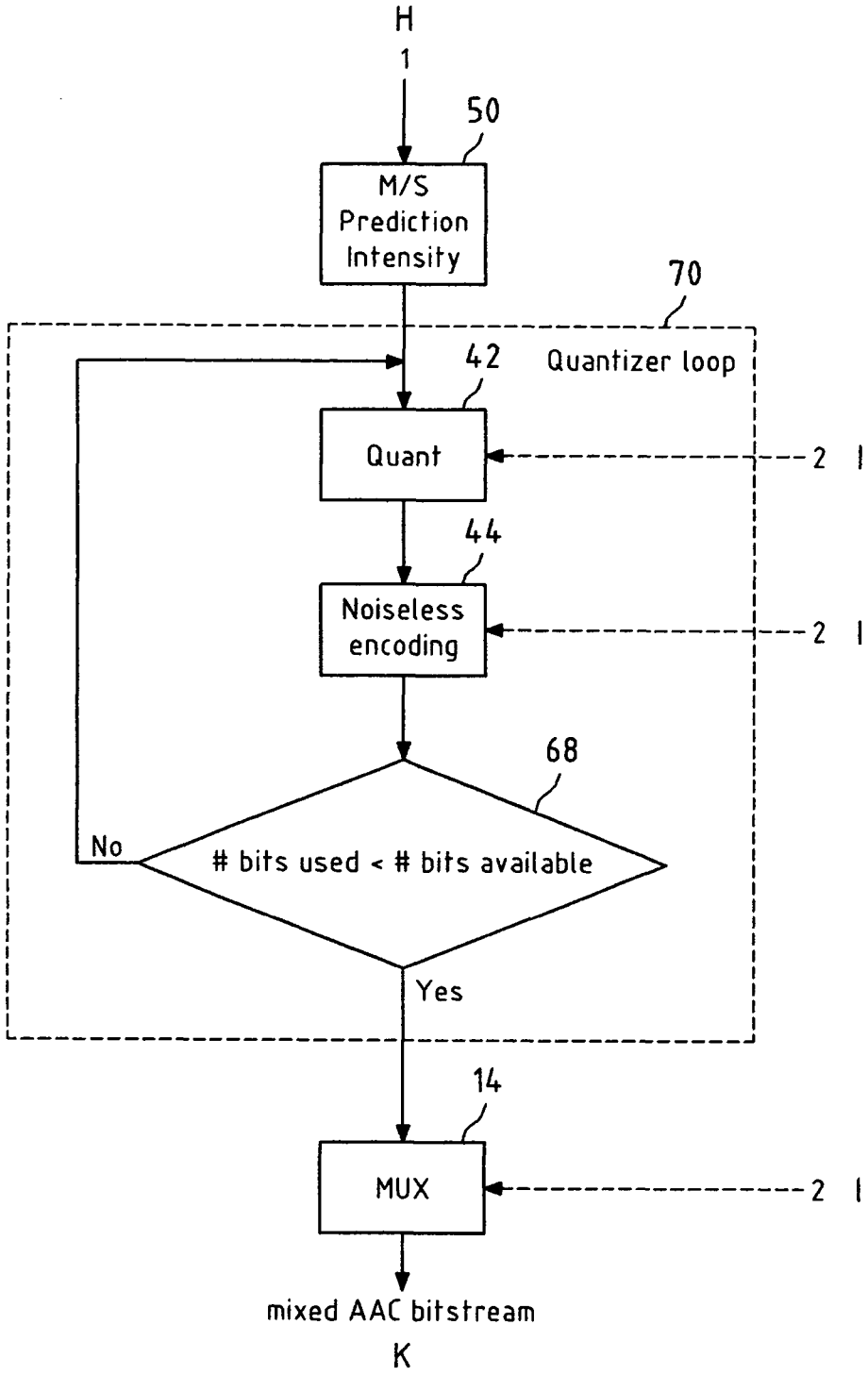

FIG. 7 illustrates encoding of the combined signal H. The signal is fed to MS-stereo and/or Intensity stereo (IS) prediction block 40. The output signal is fed to quantizer loop 70. The signal is quantized in quantizer block 42 and encoded in noiseless encoding block 44. For quantization and encoding, side information I obtained by side information decoding block 46, as shown in FIG. 6, may be used. Using the side information allows reducing computation load, as the combined signal need not be analyzed. Within formatting block 68 a bit stream is formatted. The output signals are computed by multiplexer 14 and a mixed AAC bit stream is put out as signal K.

Both software and dedicated hardware solutions could be used. However, this method may be part of the audio content creation package. The audio content creation package might be an add-on tool (plugin) for certain mobile terminals.

One additional implementation alternative advantage relates to a mp3 or AAC playback mixer. If two mp3 or AAC streams need to be played back simultaneously, it would be advantageous to mix the audio samples already during decoding and not, for example, at the output device. For playback mixer, no encoding operation would be needed. The mixing during encoding might be done as described above without re-compression of the combined signal.

Both mp3 and AAC audio formats use a non-uniform quantizer to quantize the spectral samples. At the decoder side, inverse non-uniform quantization needs to be performed. For fading effects, it is necessary to adjust the amplitude level of the dequantized spectral coefficients. When applying fading effects, some or all of the input dequantization parameters need to be modified. It has been found that both audio formats have defined a bit stream element called global_gain, which may be used for implementing a fading effect.

In MP3, the global_gain is a separate value from the scalefactors whereas in AAC, the global_gain is actually a starting value for scalefactors, which are differentially encoded for transmission. Nevertheless, by modifying only this one bit stream element, fade-in and fade-out effects may be very easily and efficiently implemented according to embodiments.

It has been found that the global_gain value is applied to the spectral domain samples. In order to create fading effects, some constraints are involved in the modification process. Just changing the global_gain value for each frame until the fading level is reached will not work. The reason for the failure of this approach is that the output volume level will not increase gradually, instead there will be a long silence at the beginning of the fade-in region and then suddenly the fade-in will take place.

To create a gradual increase or decrease in the output volume level, embodiments provide for obtaining from the bit stream of the frequency domain encoded audio signal the bit stream element representing the global amplitude level value, changing the bit stream element representing the global amplitude level value for frames and channels of the encoded audio signal with an alternation value, wherein the alternation value is changed every n-th frame, where n is determined from a number of fade levels and a length of the fading.

Figures 10, 11:
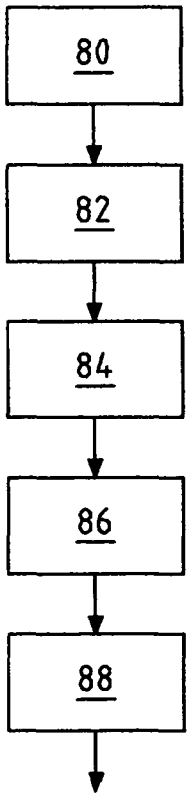
FIG. 10 a third pseudo-code for implementing a fading effect.
FIG. 11 a flowchart of a method for implementing fading.

The pseudo-codes according to FIGS. 8 to 10 illustrate how fading effects may be implemented according to embodiments for compressed audio signals without having to decode the bit stream. According to embodiments, only some simple bit stream parsing is necessary.

Some global parameters may be specified for the fading to work as intended. The pseudo-code according to FIG. 8 describes the specification of the required parameters.

The values fadevolume, frameCount, fadeMode may be input values, for instance from user inputs. The framecount parameter describes the number of successive audio frames where the fading operation should be applied. This value may be calculated from the desired length of the fading and the length of the audio frames. Each audio frame has a certain length, typically measured in milliseconds, and this parameter can be easily obtained once the width of the fading region is known. This value may typically user specified.

The value fadeVolume may describe the initial (fade-in) or the ending (fade-out) volume level relative to the original level. The range of this parameter may vary between 0 and 100 or any other upper threshold.

The value FADEZEROLEVEL is an implementation specific parameter for MP3 and AAC, but a value of 30 may for instance be used for both mp3 and AAC. The gainDec value may specify the change in the global-gain. This may be the alternation value. The value incStep may define the change of the gainDec value once the defined number n of consecutive frames have seen changed with a current gainDec value.

According to embodiments, the global_gain values are modified on a frame-by-frame basis according to the pseudo-code of FIG. 9.

The value num_mp3_granules may be the number of granules (1 or 2) in one mp3 frame, and the value num_mp3_channels may be the number of channels (mono or stereo) present in the mp3 granule. These parameters may be determined from the mp3 bit stream at the start of decoding.

The value num_syntactic_aac_elements may describe the number of syntactic channel elements in the AAC frame. This parameter may also be determined from the AAC bit stream during decoding on a frame-by-frame basis.

For editing purposes the global_gain_values have to be extracted starting from the desired bit stream location. After modification, the new values have to be inserted back to the same bit stream location.

The fading effect creation process may be summarized with the pseudo-code shown in FIG. 10. The value fadeGrid may define the number n of frames, after which the alternation value, e.g. gainDec, is changed.

The method according to embodiments is as well depicted in FIG. 11. During initialization 80, the parameters for fading are calculated according to the pseudo-code shown in FIG. 8.

After initialization 80, the global_gain values are extracted 82 from the bit stream of the compressed audio file.

The alternation value, which may be the gainDec value, may then be changed 84 with a change value, e.g. the incstep value. It may be determined from the current position of the frame, whether a change in the gainDec value is appropriate or not. In the depicted embodiment, the gainDec value is changed by the incstep value each $n^{th}$ frame, where n equals the frame Grid count. The frame Grid count may be determined from the frame count and the number of fade levels, for instance as a quotient. In other words, the gainDec value is changed by the incstep value every n=frameGrid frame.

Insofar as the alternation value is changed by a value of incstep, e.g. one, each $n^{th}$ frame, the selection of which $n^{th}$ frame is chosen may also be by logarithmic, exponential, staircase or any other curve.

After having decided whether the alternation value GainDec is changed 84, the global_gain value is changed for each channel and each granule or syntactic element 86, according to pseudo-code of FIG. 9.

The changed global_gain value is included back into the bit stream 88.

In general, the described method is valid for all audio formats that employ an exponential value in the inverse quantization or equivalent scaling formula. Whether the name of the exponential value is global_gain, or not, is irrelevant, the technique however, may remain the same.

Figure 12:
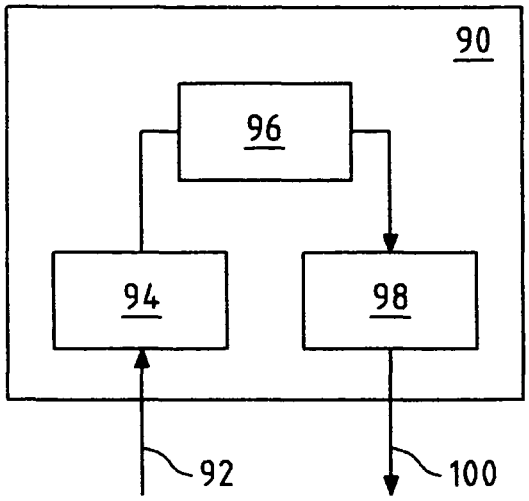
FIG. 12 schematically a block diagram of an inventive system.

FIG. 12 shows a device 90 arranged for implementing a method according to embodiments. An input 92 for receiving compressed audio files is provided. The input audio file is parsed within a parser 94 to extract the bit stream. The parser 94 may also provide the global_gain, the number of granules, the number of channels, the number of syntactic elements, the length of an audio frame and any other information available from the bit stream.

The global_gain values are passed to a processor 96. Within the processor 96, the frames, where the global_gain value is changed, as well as the alternation value is calculated and the respective global_gain values are changed.

A further processor 98 may be provided, to allow including the altered global_gain value into the bit stream. An output 100 may provide a compressed audio signal with a fading effect.

Processors 96 and 98 each include a computer readable medium stored with instructions for carrying out the actions recited herein.

While there have been shown and described and pointed out fundamental novel features of the invention as applied to a preferred embodiment thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method performed by an apparatus, comprising:

receiving frequency domain encoded signals from at least two audio signal sources, decoding the frequency domain encoded signals, obtaining quantized spectral components, inverse quantizing the quantized spectral components of the decoded signals of the two signals obtaining at least first and second window sequences, inverse transforming at least one first window sequences obtaining a sub-band signal, and re-transforming the sub-band signal into a modified window sequence with a frequency resolution matching a frequency resolution of a second window sequence from a signal which has not been inverse transformed, combining the first modified window sequence with a second window sequence of a signal, which has not been inverse transformed into a combined window sequence obtaining a combined signal of the at least two audio signals, providing the combined signal as an output signal.

2. The method of claim 1, comprising providing alias reduction to at least one of the window sequences.

3. The method of claim 1, comprising transforming and/or re-transforming the combined window sequence according to a lapped orthogonal transformation.

4. The method of claim 1, comprising inverse transforming at least two of the window sequences and combining the transformed windows sequences within the same transformation domain.

5. The method of claim 1, comprising inverse transforming at least two of the window sequences into a sub-band signal, respectively, and combining at least two of the sub-band signals into a combined sub-band signal.

6. The method of claim 5, comprising re-transforming the combined sub-band signal into combined window sequence.

7. The method of claim 6, comprising transforming and/or re-transforming the combined window sequence according to a lapped orthogonal transformation.

8. The method of claim 1, comprising providing amplitude level adjustment to the signals to be combined.

9. The method of claim 1, comprising providing band-limiting at least one of the signals prior to combining the signals.

10. The method of claim 1, comprising quantizing the combined signal into spectral components.

11. The method of claim 10, comprising encoding the spectral components of the combined signal into a frequency domain encoded output signal.

12. The method of claim 10, comprising formatting a bit stream of the frequency domain encoded output signal.

13. The method of claim 1, comprising utilizing side information obtained from at least one of the encoded signals for decoding and/or inverse quantizing, and/or for quantizing and/or encoding the combined signal.

14. The method of claim 1, comprising providing MPEG-1, 2, 2.5 layer-3 encoded signals or advanced audio coding encoded signals, or MPC Musepack encoded signals, or Ogg Vorbis encoded signals, or Windows Media Audio encoded signals, or AC3 encoded signals from combination.

15. An apparatus comprising:

a receiver configured to receive frequency domain encoded signals from at least two audio signal sources, a decoder configured to decode the frequency domain encoded signals, obtaining quantized spectral components, an inverse quantizer configured for inverse quantizing the quantized spectral component of the decoded signals of the two signals obtaining at least first and second window sequences, an inverse transformer configured for inverse transforming at least one first window sequences obtaining a sub-band signal, and re-transforming the sub-band signal into a modified window sequence with a frequency resolution matching a frequency resolution of a second window sequence from a signal which has not been inverse transformed, and a combiner configured for combining the first modified window sequence with a second window sequence of a signal, which has not been inverse transformed into a combined window sequence obtaining a combined signal, wherein the apparatus is configured for providing the combined signal as an output signal.

16. A mobile communication device comprising:

a receiver configured to receive frequency domain encoded signals from at least two audio signal sources.

a decoder configured to decode the frequency domain encoded signals, obtaining quantized spectral components, an inverse quantizer arranged for inverse quantizing the quantized spectral component of the decoded signals of the two signals obtaining at least first and second window sequences, an inverse transformer configured for inverse transforming at least one first window sequences obtaining a sub-band signal, and re-transforming the sub-band signal into a modified window sequence with a frequency resolution matching a frequency resolution of a second window sequence from a signal which has not been inverse transformed, and a combiner configured for combining the first modified window sequence with a second window sequence of a signal, which has not been inverse transformed into a combined window sequence obtaining a combined signal, wherein the mobile communication device is configured for providing the combined signal as an output signal.

17. A method for providing fading within a frequency domain encoded audio signal performed by an apparatus, comprising:

receiving a frequency domain encoded audio signal, obtaining from a bit stream of the frequency domain encoded audio signal, a bit stream element representing a global amplitude level value, changing the bit stream element representing the global amplitude level value for frames and channels of the encoded audio signal with an alternation value so as to provide said fading within said frequency domain encoded audio signal, wherein the alternation value is changed every $n^{th}$ frame, where n is determined from a number of fade levels and a length of the fading, and providing the frequency domain encoded audio signal as output signal, wherein said fading is within the provided frequency domain encoded audio signal.

18. The method of claim 17, with determining n from the quotient of the number of fade levels and the length of the fading.

19. The method of claim 17, with changing the bit stream element representing the global amplitude level value for each frames and each channels within a fading period of the encoded audio signal.

20. The method of claim 17, with determining a fade volume from an initial amplitude level or an ending amplitude level relative to the original amplitude level.

21. The method of claim 17, with extracting the bit stream element representing the global amplitude level from the bit stream, changing the bit stream element representing the global amplitude level, and inserting the changed bit stream element representing the global amplitude level into the bit stream.

22. A device configured for providing fading within a frequency domain encoded audio signal, comprising a receiver configured to receive a frequency domain encoded audio signal, a parser configured to obtain from a bit stream of the frequency domain encoded audio signal the bit stream element representing a global amplitude level value, a processing unit configured to change the bit stream element representing the global amplitude level value for frames and channels of the encoded audio signal with an alternation value, wherein the processing unit is arranged to change the alternation value every n-th frame, where n is determined from a number of fade levels and a length of the fading, wherein the device is configured to provide the frequency domain encoded audio signal as output signal, wherein said fading is within said provided frequency domain encoded audio signal.

23. A mobile communication device comprising:

a receiver configured to receive a frequency domain encoded audio signal, parser configured to obtain from the bit stream of a frequency domain encoded audio signal, a bit stream element representing a global amplitude level value, a processing unit configured to change the bit stream element representing the global amplitude level value for frames and channels of the encoded audio signal with an alternation value, wherein the processing unit is configured to change the alternation value every n-th frame, where n is determined from a number of fade levels and a length of the fading, wherein the mobile communication device is configured to provide the frequency domain encoded audio signal as output signal, wherein said fading is within said provided frequency domain encoded audio signal.

24. A consumer electronic device comprising:

a receiver configured to receive frequency domain encoded signals from at least two audio signal sources, a decoder configured to decode frequency domain encoded signals from at least two signal sources, obtaining quantized spectral components, an inverse quantizer arranged for inverse quantizing the quantized spectral component of the decoded signals of the two signals obtaining at least first and second window sequences, an inverse transformer configured for inverse transforming at least one first window sequences obtaining a sub-band signal, and re-transforming the subband signal into a modified window sequence with a frequency resolution matching a frequency resolution of a second window sequence from a signal which has not been inverse transformed, and a combiner configured for combining the first modified window sequence with a second window sequence of a signal, which has not been inverse transformed into a combined window sequence obtaining a combined signal, wherein the consumer electronic device is configured for providing the combined signal as an output signal.

25. An electronic device comprising:

a receiver configured to receive a frequency domain encoded audio signal, a parser configured to obtain from the bit stream of a frequency domain encoded audio signal, a bit stream element representing a global amplitude level value, a processing unit configured to change the bit stream element representing the global amplitude level value for frames and channels of the encoded audio signal with an alternation value, wherein the processing unit is configured to change the alternation value every n-th frame, where n is determined from a number of fade levels and a length of the fading, wherein the electronic device is configured to provide the frequency domain encoded audio signal as output signal, wherein said fading is within said provided frequency domain encoded audio signal.

* * * * *